US006413591B1

(12) United States Patent
Dettling et al.

(10) Patent No.: US 6,413,591 B1
(45) Date of Patent: Jul. 2, 2002

(54) METHOD OF COATING CELLULOSIC AND LIGNOCELLULOSIC WEBS

(75) Inventors: Bernhard Dettling, Chatenois (FR); Heikki Ahonen, Ritvala (FI)

(73) Assignee: ISI-HEAD Oy, Ritvala (FI)

( * ) Notice: Subject to any disclaimer, the term of this patent is extended or adjusted under 35 U.S.C. 154(b) by 0 days.

(21) Appl. No.: 09/403,221

(22) PCT Filed: Apr. 16, 1998

(86) PCT No.: PCT/FI98/00341

§ 371 (c)(1),
(2), (4) Date: Nov. 8, 1999

(87) PCT Pub. No.: WO98/46829

PCT Pub. Date: Oct. 22, 1998

(30) Foreign Application Priority Data

Apr. 16, 1997 (EP) ..... 97660042

(51) Int. Cl.[7] ..... B05D 1/04; D21H 19/38

(52) U.S. Cl. ..... 427/462; 427/486; 427/201; 427/326; 427/391; 162/136; 162/DIG. 9

(58) Field of Search ..... 427/201, 209, 427/288, 324, 326, 444, 356, 358, 391, 462, 486, 180; 162/4, 9, 12, 135, 136, 189, 190, 129, 130, DIG. 9

(56) References Cited

U.S. PATENT DOCUMENTS

| | | | | |
|---|---|---|---|---|
| 3,119,708 | A | | 1/1964 | Munck |
| 4,089,738 | A | * | 5/1978 | Kankaanpaa |
| 5,263,999 | A | * | 11/1993 | Baldwin et al. |

FOREIGN PATENT DOCUMENTS

| | | | |
|---|---|---|---|
| EP | 604 095 | * | 6/1994 |
| EP | 0 704 753 | | 4/1996 |
| WO | 85/03316 | | 8/1985 |

* cited by examiner

*Primary Examiner*—Fred J. Parker
(74) *Attorney, Agent, or Firm*—Smith-Hill and Bedell

(57) ABSTRACT

A method for coating paper, wherein a coating composition containing coating particles is applied to the surface of a paper web containing lignocellulosic fibers to produce a coated paper web having coating particles bound to the paper web, and the coated web is dried. According to the method the surface area of the interface between the paper web and the coating particles is increased in order to enhance hydrogen bonding between the coating particles and the fibers of the web. The surface area can be increased by using a coating composition comprising fine fibrous material or by abrading the surface of the paper or paperboard web or both. The invention will improve the smoothness of the surface without addition of foreign polymer binding agents to the web.

33 Claims, No Drawings

METHOD OF COATING CELLULOSIC AND LIGNOCELLULOSIC WEBS

BACKGROUND OF THE INVENTION

1. Field of the Invention

The present invention relates to the manufacture of paper and paperboard. In particular, the present invention concerns a novel method for coating paper, paperboard and similar cellulosic and lignocellulosic webs. Generally, such a method comprises the steps of applying a coating composition containing coating particles to the surface of a paper or paperboard web containing cellulosic fibers, and drying the coated web to produce a coated product.

2. Description of Related Art

Paper and paperboard are coated for many different reasons, e.g. for improving smoothness and opacity, for grease proofing, for providing release properties, and for achieving barrier properties against many different substances, such as oxygen and aroma. The surface of a base paper is always rough and in many cases the purpose of coating is to fill the unevennesses and to achieve better quality of the surface for printing and possibly for a secondary functional coating.

The weight of the coating layer is normally only 5 to 20%, in some cases, however, up to 40%, of the mass of the base paper. Very often the coating layer contains, some pigments in order to improve printability, brightness and opacity. Normally, all these functionary chemicals and pigments are bound to the surface of base paper sheet with some organic polymers, which often are applied in the form of latexes, e.g. as aqueous polymer emulsions.

Coated papers are frequently calendered in order to obtain a smoother finished surface for printing and for coating.

The paper coating and finishing methods used nowadays have some considerable drawbacks, such as waste production from secondary usage of the papers and deinking problems. In particular, the reuse of the paper would be much easier if polymer materials in the paper or paperboard could be avoided. Some polymer materials may even shorten the shelf life of the paper as a document paper.

Although calandering will improve surface smoothness and gloss of the coated papers, tests with newsprint and normal LWC papers carried out at paper mills in Finland using calenders with line-pressures in the range of 100 to 120 kN/m have shown that calendering decreases the tear strength of the paper considerably, up to 31%, and it will also decrease the opacity of paper by up to 35%. Similarly, the burst strength drops up to 38%.

SUMMARY OF THE INVENTION

It is an object of the invention to eliminate the problems related to the prior art and to provide a novel method for coating paper and paperboard and similar cellulosic webs.

This and other objects, together with the advantages thereof over known methods, which shall become apparent from the specification which follows, are accomplished by the invention as hereinafter described and claimed.

It is known in the art that paper must be refined before sheet forming. Refining will liberate fibrils (tiny, thin parts of the fibre) from the fibres while still keeping most of them in the original fibre. These fibrils improve the strength of the paper sheet. In fact, paper web formation on a paper machine is, to a substantial extent, based on hydrogen-bonding between adjacent fibres and fibrils. The bonds are created when the wet web formed on a wire is dried. There are also some hydrogen bonds present between the surface of a paper or paperboard web and the coating applied thereto.

The invention is based on improving and enhancing hydrogen bonding between the coating particles and the cellulosic or lignocellulosic fibres of the web by increasing the surface area in the interface between the coating particles and the fibres. As a result, the coating particles will become more strongly bonded to the surface of the web so that coating is possible even without the use of polymeric binders. Preferably, the increased surface area in said interface is formed by using finely divided fibrous matter in the interface. This matter can stem from the web or be a part of it and/or it can comprise fibrous coating particles. Thus, an increased surface area in the interface between the coating particles and the cellulosic or lignocellulosic web can be provided by selecting a web which has an enlarged surface area and/or by selecting coating particles which have a greater surface than corresponding conventional particles and/or fibres.

Considerable advantages are achieved by the present invention. Thus, the present invention provides anchoring of pigment particles to the base web without any polymer usage and entirely without any foreign or secondary materials being introduced into the paper or, in certain cases, by using only relatively small amounts of polymer. Thus, because the present invention employs no or essentially no polymer binding material, the desired pigmenting function can be made using smaller amounts of pigments than in cases where polymers are used as binding aids.

The repulping of this paper web, where the coating is made with pigments and fines alone, is much easier than repulping of paper where polymers are used to bind the pigment on the web.

It is well known that the scattering coefficient of pigments and the opacity provided by said coefficient is dependent on the light refraction index between the pigments and the intimate material of the pigments, like polymers etc. During recirculation of a material of the present kind, the opacity of the recirculated products is not lowered as is the case with waste paper containing large amounts of polymeric materials.

The invention will improve the smoothness of the surface without addition of foreign polymer binding agents to the web. This opens up new dimensions for paper making. A smooth surface can now be achieved more easily than with other known paper surface finishing methods (e.g. calandering), while the strength and optical properties are kept almost on the original level. By mechanically treating the surface it can be made very even with the use of small amounts of pigments only.

The present method will offer great possibilities for rebuilding even older paper machines for novel use and for more flexible product range, making different specialities.

DETAILED DESCRIPTION OF THE INVENTION

Next the invention will be examined in more detail with the aid of the following detailed description and with reference to a working example.

Within the scope of the present invention, the terms "cellulosic" and "lignocellulosic" are used to designate materials derived from cellulose and lignocellulosic materials, respectively. In particular "cellulosic" refers to material obtainable from chemical pulping of wood and other plant raw material. Thus, a web containing "cellulosic fibres" is made for example from kraft, sulphite or organosolv pulp. "Lignocellulosic" refers to material obtainable from wood and other plant raw material by mechanical defibering, for example by an industrial refining process, such as refiner mechanical pulping (RMP), pressurized refiner mechanical pulping (PRMP), thermomechanical pulping (TMP), groundwood (GW) or pressurized groundwood (PGW) or chemithermomechanical pulping (CTMP).

The terms "paper" and "paperboard" refer to sheet-formed products containing cellulosic or lignocellulosic fibres. "Paperboard" is synonymous with "cardboard". The grammage of the paper or paperboard can vary within broad ranges from about 30 to about 500 g/m$^2$. The present invention can be employed for coating of any desired paper or paperboard web to obtain a coated product having an increased opacity and brightness and improved printability. As a practical matter, the term "paper" or "paper web" is herein used to designate both "paper" and "paperboard" and "paper web" and "paperboard web", respectively.

The terms "fines", "fibrils" and "fibres" denote finely divided material having a cross-sectional diametre of less than about 0.5 mm, typically in the range of 0.001 to 0.2 mm and the "fibrils" and "fibres" are materials having a length to cross-section diameter ratio of more than about 6. In particular, the fibrous or fines material comprises fibres whose size is less than one tenth of the corresponding size of the fibres of the web. The surface area-to-mass unit ratio of the material is generally more than ten times larger than the corresponding ratio of the fibres of the web. In the following text, the term "fines" are occasionally used to designate the whole fraction of finely divided material obtainable from, e.g., process waters, which normally is not retained on the wire.

"Coating" stands for providing a layer on at least one surface of the cellulosic or lignocellulosic web. The layer is preferably continuous and its grammage (mass per unit area) is about 2 to 100% of the grammage of the web, preferably about 5 to 70 wt-%. The coating layer contains coating particles, such as fines, fibrils and fibres and/or pigments known per se.

The "roughness" of the web which is to be coated is generally given as "microns" ($\mu$m). The print-surf surface roughness at 1000 kPa can be measured according to, for example, ISO 8791–4:1992 (E). Typically the roughness of paper webs is in the range of 8 to 2 microns. As discussed below and shown in the working examples, by subjecting the surface of a paper or paperboard web to an abrasive treatment according to the invention, it is possible to reduce the roughness of the web by at least 20%, preferably over 40%, thus creating a larger surface area of the web.

The "interface" between the paper web and the coating particles is the area on which there is some contact or interaction between the web and the particles.

According to one preferred embodiment, the invention comprises the steps of recovering a fraction of finely divided material containing cellulosic or lignocellulosic fines, fibrils and fibres, forming the finely divided material into a paste which optionally contains pigments and other coating colour components known per se and coating a paper or paperboard web with said paste.

The fines and the fibrils will form higher strength with hydrogen bonds on the paper than will the fibres themselves. On the other hand, the dense net of hydrogen bonds on the surface may bring some brittleness to the structure. However, such brittleness does not greatly affect the burst strength of the whole web, because the coating layer can be made rather thin. Furthermore, when said thin coating layer also contains filling minerals and/or other functional particles, the brittleness will be neutralized because of the lower number of hydrogen bonds between the fines and the base fibres.

In this context it should be noted that it is known in the art to collect fines and to mix them with pigments for further use. Thus, U.S. Pat. No. 5,558,782 discloses a method in which fines mixed with a calcium hydroxide solution are recovered and this mixture is carbonated for forming precipitated calcium carbonate and, at the same time, the fines are co-precipitated with these PCC particles. The material is filtered and reused for paper making. U.S. Pat. No. 5,527,432 teaches dry grinding of a paper sludge containing fines and pigments and mixing the sludge again for paper making use.

Neither of these references discloses grinding of base paper surface and the use of that waste for paper surface coating. Nor does either of them make use of the fines for coating with or without pigments, nor with or without polymers or similar secondary materials.

According to another preferred embodiment, the invention comprises the steps of abrading a paper or paperboard web to increase the specific surface area of its surface (and in order to decrease its roughness) and coating the thus modified web with a suitable coating colour. This coating colour can comprise a paste as described above or a conventional coating colour.

It is known in the art to polish paper webs with powdered abrasives in order to improve the surface of the paper in comparison to normal supercalendering is disclosed in U.S. Pat. No. 2,349,704. Another method for making a smooth web surface without super-calendering by only using frictional rubbing action, known as friction-type calendering, is described in U.S. Pat. No. 4,089,738. The combination of a grinding or abrading step and a coating step using finely divided matter in a coating mix is not, however, anticipated or suggested in the two references.

As is apparent from the afore-said, the present invention can be carried out in a number of different ways depending on the source of finely divided fibrous material. This material can be recovered from effluents of a paper or paperboard machine or from various streams recirculated within such a machine (Alternative I) or it can be obtained from the paper or paperboard web itself (Alternative II). As discussed in connection with the second embodiment above, the increased hydrogen bonding can, however, also be based on an increase of open hydrogen surface bonding sites on the web which are produced by mechanical treatment of the surface thereof. This embodiment (Alternative III) will be separately examined.

According to the method of the present invention the coated paper can be additionally functionally coated on the same side or on the other side. In all embodiments, the paper can be coated on both sides with the same coating mix or on each side with differently treated fines and similar or dissimilar pigments.

Alternative I

The fines of circulating paper machine water systems largely comprise loose fibrils from the fibres known as zero-fibres. For the purpose of the present method, these fibres, fines and fibrils can be recovered from the circulating stream and concentrated by evaporation of water.

Suitable circulating streams are represented by the internal circulation streams of a paper or paperboard machine, such as the "white water" of the short circulation of a paper or cardboard machine. The aqueous stream known as "white water" is a stream collected from the wire in a white water chest (also known as a wire pit) and then recirculated to the head box via a mixing pump in which it is mixed with an aqueous slurry from the machine chest. Conventionally the white water contains about 1% of suspended solid matter, mainly consisting of the above-mentioned zero-fibres.

Other circulating streams, which contain suspended solid matter which can be used for coating purposes, comprise the internal circulation streams of mechanical or chemi-mechanical pulping processes. Typically such streams can be obtained as brown water from dewatering of the refined pulp. These streams comprise the effluents of processes for increasing the dry matter content of the raw material by, e.g., pressing, filtering or precipitation. The process water can also stem from a washing operation of the refined pulp. According to a third embodiment, the fines are recovered from an aqueous stream which is recycled from a paper or cardboard machine to a mechanical or chemi-mechanical pulping process.

The fines and fibrils can also be made by heavy refining of mechanical or chemical pulp using normal conical or plate refiner. Furthermore, it is possible to obtain suitable additional fine fibres and fibrils from waste paper handling and screening.

The coating particle filter cake obtained when the solid matter is recovered from aqueous streams can be used as a precoat filter to concentrate more fines from suitable waste water stream.

Alternative II

At least a part of the fibers and fines can be recovered from the web which is to be coated. According to this alternative, the fines, fibrils and fibres used as coating particles are obtained from the base web by abrasive means in dry state. The abrasion step is discussed in more detail below under Alternative III. The fines are collected and mixed with water or an aqueous solution to form a paste which optionally is combined with pigments. The abraded fines are recirculated and used for coating of the original web, and the coating/web combination is then dried again. The paper web can be wet or dry.

When the fines and pigments or only fines itself are recirculated to the wet web the recycled material can be fed to the paper machine to an earlier point than from where these fines were removed. The abraded fines can also be returned with pigments or without extra pigment to a later stage of the web with suitable water content.

Coating Mixes

In both of the alternatives disclosed above, the finely divided material recovered can be applied to the paper or paper board web as such or reformulated in the form of a coating mix or coating colour known per se. In the latter case it is preferred to use a composition which contains about 50 to 150 parts by weight of at least one coating particle and pigment, about 0 to 30 parts by weight of at least one binding agent and 0 to 10 parts by weight of other known additives in the form of an aqueous paste or slurry.

The solids matter concentration or content of the paste is usually 30 to 75 wt- %.

Suitable light-scattering pigments are exemplified by calcium carbonate, calcium sulphate, aluminium silicate and aluminium hydroxide, aluminium magnesium silicate (kaolin), titanium dioxide and barium sulphate as well as mixtures of said pigments. Even synthetic pigments can be used. Fine grain pigment will absorb more oil from printing ink and let the inks flow to the side of pixels place minimum amount. In this respect particularly preferably pigments are percipitated calcium carbonate (PCC) and silica ($SiO_2$) pigments. The inorganic pigment material preferably has a particle size in the range of 40 nm to 2 $\mu$m.

Synthetic and polymeric binding agents do not necessarily have to be used in the present invention because the finely divided material will anchor the pigments and itself to the surface of the cellulosic or lignocellulosic web. However, if necessary to improve attachment of the coating, the coating mixes can contain some binding agents conventionally used in the production of paper for the preparation of coating mixes. As typical examples, synthetic latexes may be cited which are composed of polymers or copolymers of ethylenically unsaturated compounds, e.g., butadiene-styrene copolymers which possibly further contain a comonomer having a carboxyl group such as acrylic acid, itaconoic acid, or maleic acid, and polyvinyl acetate which contains a comonomer with carboxyl groups. Binding agents which can be used together with the above-listed agents are comprised of starch or casein, polyvinyl alcohol, polyimides and polymers of low molecular weight having carboxyl groups.

Alternative III

As mentioned above, the second embodiment of the invention comprises removal of fines from the surface by abrasive means and the use of the smooth surface paper as such or after coating, e.g. normal blade coating. The purpose of the abrasive treatment is to reduce the roughness of the surface and to increase the specific surface area thereof. As mentioned above, the roughness is usually reduced by at least 20%, preferably at least 40%.

The abrasive agent can be applied to the surface of the paper web using an abrasive agent carrier in the form of a belt, a roll or an air jet. In particular, a belt is used as a carrier and the abrasive particles are bound to the belt or loosely held by the belt between the paper web and the belt itself. The abrasive particles can be implanted into the belt. The belt used is metallic or it comprises a plastic belt or a woven belt made from a suitable polymer. The paper or paperboard web should preferably be abraded against a hard surface.

To achieve proper abrasive action, there is a velocity difference between the base web and the abrasive agent carrier. The abrasive equipment can, however, also comprise a blade coater operating at dry conditions.

The paper or paperboard web subjected to abrasive treatment should be so dry that it will endure abrasion essentially without loosing its strength properties. Therefore, the moisture content of the web should preferably be less than 50%, in particular less than 40%.

It is preferred to use as abrasive particles the same pigment that is intended to be used for later coating of said sheet web. The finer the abrasive pigments are the better the printing character of the paper that can be obtained due to the greater specific surface area. Any of the above-mentioned pigments can be used as abrasive agents. Preferably, the abrasive pigment is selected from the group consisting of mineral pigments and metallic pigments. Particularly preferred pigments are $TiO_2$, $Al_2O_3$ and metallic pigments. When $Ca(OH)_2$ is used as an abrasive pigment it can be converted to calcium carbonate after application to the web surface simultaneously with final drying of the paper web, preferably by using catalytic gas burners.

After abrasion, the fines and the abrasive particles can be collected by using electrostatic propulsion. Thus, the particles and fine are charged, e.g. provided with a negative charge, and sucked towards an electrode having an opposite charge.

The treatment will result in the surface of the web becoming more even and smoother and contains an increased number of hydrogen bonding sites on the surface. These sites can be used for binding coating particles, such as conventional pigments and/or fines, fibrils and fibres.

The abrasive particles and fines separated from the surface are collected and, as explained above, they are together applied to an abraded paper web surface in the form of an aqueous slurry to form an aqueous coating on the web, and then the coated web is dried in order to form hydrogen bonds to keep the fines and pigments with the surface and to resist, without dusting, conventional after-treatments of paper webs. The abrasive particles and fines can be used together with a water-soluble or emulsion-forming polymer, as mentioned above.

This invention can be realised on paper machine in many ways as it is already clear.

Finally, it should be pointed out that when pigments are used for coating, only hydrogen bond forces can be used as primary holder of the pigment particles on paper fibre web. As explained above, the present invention does not exclude the use of normal polymeric binding aids, but makes the use on them much less or even zero.

Paper fibres, fibrils and fines are anionic, i.e. negatively charged, which offers a new improved method to bring the fines and pigments back to the surface. Therefore, cationic treatment of the fines and pigments is advantageous before bringing them back to the surface where lots of fibrils are waiting with negative charge. This clearly means more strength bonding of secondary material to the surface without any polymer materials.

A paper or paperboard product prepared according to the present invention can be posttreated by known methods, for example by the soft calander method or a similar process.

The following non-limiting example illustrates the invention:

EXAMPLE

The following treatment was made in laboratory to a drawing cartoon. First, the surface was ground with sandpaper number 1000 and the surface was cleaned from loose fines. The loose fines were mixed to a PCC pigment suspension (60% dry solids), having particle sizes in the range of 0.05 to 0.1 micron. The coating was made with steel blade at a load of about 13–15 gr/m$^2$ in the wet stage. The difference between the ground surface and the coated surface was measured optically. The base paper had a roughness of 7.95 microns, with a deviation of one micron. The twice treated (ground and coated) paper had a roughness of 4.5 microns and a deviation of 0.17 microns.

What is claimed is:

1. A method for coating paper, comprising the steps of:

a. applying a coating composition containing fine fibrous material and pigments to a surface of a paper web containing lignocellulosic fibers to produce a coated paper web having the fine fibrous material bound thereto, whereby the fine fibrous material increases the surface area at the interface between the paper web and the fine fibrous material in order to generate hydrogen bonding between the fine fibrous material and the fibers of the paper web and said pigments are bound to the surface of the paper web essentially with the hydrogen bonding generated between the fine fibrous material of the coating composition and the fibers of the paper web, and b. drying the coated paper web, wherein the fine fibrous material is recovered from a water stream of a manufacturing process used to produce a paper web.

2. The method according to claim 1, wherein the fine fibrous material comprises fibers whose size is less than one tenth of the corresponding size of the fibers of the paper web.

3. The method according to claim 1, wherein the fine fibrous material comprises fibers the surface area-to-mass unit ratio of which is more than ten times larger than the corresponding ratio of the fibers of the paper web.

4. The method according to claim 1, comprising recovering the fine fibrous material from a fiber-containing waste-water stream or from a circulating process water stream.

5. The method according to claim 1, wherein the fiber-containing waste-water is white water.

6. The method according to claim 1, wherein the coating composition applied in step a includes a water-soluble or emulsion-forming polymer for binding the fine fibrous material and the pigments to the paper web surface.

7. The method according to claim 1, wherein step a comprises applying the coating composition in the form of an aqueous slurry, and wherein the method comprises, prior to step a:

abrading the surface of the paper web with abrasive particles, recovering the abrasive particles and fine fibrous material abraded from the surface of the paper web, and forming the aqueous slurry from the recovered abrasive particles and fine fibrous material abraded from the surface of the paper web.

8. The method according to claim 7, wherein the abrasive particles are abrasive pigment particles.

9. The method according to claim 8, comprising chemically treating the fine fibrous material and abrasive pigment particles to electrostatically charge the fine fibrous material and abrasive pigment particles prior to forming the aqueous slurry.

10. The method according to claim 1, wherein step a comprises applying the coating composition in the form of an aqueous mixture, and the method comprises, prior to step a:

abrading the surface of the paper web, recovering fine fibrous material abraded from the surface of the paper web, mixing the recovered fine fibrous material with pigment, and forming the aqueous mixture by wetting the recovered fine fibrous material and pigment to a solids concentration of 30–70 percent by weight.

11. The method according to claim 1, wherein the coating composition includes fine fibers or fibrils obtained from waste paper handling and screening.

12. The method according to claim 1, wherein the coating composition includes inorganic pigment material having a particle size between 40 nanometers and 2 micrometers.

13. A method for coating paper, comprising the steps of:

a. applying a coating composition containing fine fibrous material and pigments to a surface of a paper web containing lignocellulosic fibers to produce a coated paper web having the fine fibrous material bound thereon, whereby the fine fibrous material increases the surface area at the interface between the paper web and the fine fibrous material in order to generate hydrogen bonding between the fine fibrous material and the fibers of the paper web and said pigments are bound to the surface of the paper web essentially with the hydrogen bonding generated between the fine fibrous material of the coating composition and the fibers of the paper web, and b. drying the coated paper web, wherein the fine fibrous material is recovered from fibers released from the paper web which is to be coated or from another paper web manufactured in a paper web manufacturing process.

14. The method according to claim 13, wherein the method comprises, prior to step a:

abrading the surface of the paper web with an abrasive agent comprising the coating composition, recovering fine fibrous material abraded from the surface of the paper web, and adding the recovered fine fibrous material recovered from the paper web to the coating composition.

15. The method according to claim 14, comprising applying the abrasive agent to the surface of the paper web using an abrasive agent carrier in the form of a belt, a roll or an air jet.

16. The method according to claim 15, wherein the abrasive agent carrier is a belt and wherein the abrasive agent is bound to the belt or loosely held by the belt between the paper web and the belt.

17. The method according to claim 16, wherein a velocity difference between the paper web and the abrasive agent carrier aids in removing fine fibrous material from the paper web surface.

18. The method according to claim 15, wherein the abrasive agent carrier comprises a blade coater operated under dry conditions.

19. The method according to claim 13, comprising adding to the coating composition a water-soluble or emulsion-forming polymer for binding the fine fibrous material to the paper surface.

20. The method according to claim 13, wherein the pigment is selected from the group consisting of mineral pigments and metallic pigments.

21. The method according to claim 20, wherein the pigment is $Ca(OH)_2$, and wherein step b comprises converting the pigment to calcium carbonate while drying the coated paper web.

22. The method according to claim 21, wherein step b. comprises employing catalytic gas burners.

23. The method according to claim 13, wherein step a. comprises applying the coating composition in the form of an aqueous slurry, and the method comprises, prior to step a:

abrading the surface of the paper web with abrasive particles, recovering the abrasive particles and fine fibrous material abraded from the surface of the paper web, and forming the aqueous slurry from the recovered abrasive particles and fine fibrous material abraded from the surface of the paper web.

24. The method according to claim 23, wherein the abrasive particles are abrasive pigment particles.

25. The method according to claim 24, comprising chemically treating the fine fibrous material and abrasive pigment particles to electrostatically charge the fine fibrous material and abrasive pigment particles prior to forming the aqueous slurry.

26. The method according to claim 13, wherein step a. comprises applying the coating composition in the form of an aqueous mixture, and the method comprises, prior to step a:

abrading the surface of the paper web, recovering fine fibrous material abraded from the surface of the paper web, mixing the recovered fine fibrous material with pigment, and forming the aqueous mixture by wetting the recovered fine fibrous material and pigment to a dry matter concentration of 30–70 percent by weight.

27. The method according to claim 13, wherein the coating composition includes fine fibers or fibrils obtained from waste paper handling and screening are used.

28. The method according to claim 13, wherein the coating composition includes inorganic pigment material having a particle size between 40 nanometers and 2 micrometers.

29. The method according to claim 13, wherein the fine fibrous material comprises fibers whose size is less than one tenth of the corresponding size of the fibers of the paper web.

30. The method according to claim 13, wherein the fine fibrous material comprises fibers the surface area-to-mass unit ratio of which is more than ten times larger than the corresponding ratio of the fibers of the paper web.

31. A method for coating paper, comprising the steps of:

a. abrading a surface of a paper web containing lignocellulosic fibers, whereby the surface area of the surface of the abraded paper web is increased relative to the surface of the paper web prior to being abraded, b. applying a coating composition containing coating particles and pigments to the abraded surface of the paper web to produce a coated paper web having the coating particles bound thereon, whereby the increased surface area of the surface of the paper enhances hydrogen bonding between the coating particles and the fibers of the paper web and said pigments are bound to the surface of the paper web essentially with the hydrogen bonding generated between the fine fibrous material of the coating composition and the fibres of the paper web, and c. drying the coated paper web.

32. The method according to claim 31, wherein step a comprises abrading the paper web using an abrasive agent applied to the surface of the paper web by an abrasive agent carrier in the form of a belt, a roll or an air jet.

33. The method according to claim 32, wherein a velocity difference between the paper web and the abrasive agent carrier aids in removing fine fibrous material from the paper web surface.

* * * * *

UNITED STATES PATENT AND TRADEMARK OFFICE

CERTIFICATE OF CORRECTION

PATENT NO. : 6,413,591 B1 
DATED : July 2, 2002
INVENTOR(S) : Bernhard Dettling and Heikki Ahonen It is certified that error appears in the above-identified patent and that said Letters Patent is hereby corrected as shown below:

Title page,
Item [73], "Assignee: ISI-HEAD Oy, Ritvala (FI)" should be deleted and replaced with -- [73] Assignee: IDI-HEAD OY, Ritvala (FI) --.

Signed and Sealed this

Fifteenth Day of October, 2002

*Attest:*

*Attesting Officer*

JAMES E. ROGAN
*Director of the United States Patent and Trademark Office*